US010278454B2

(12) United States Patent
Kohatsu et al.

(10) Patent No.: US 10,278,454 B2
(45) **Date of Patent: *May 7, 2019**

(54) FOOTWEAR WITH INTERNAL HARNESS

(71) Applicant: NIKE, Inc., Beaverton, OR (US)

(72) Inventors: Shane S. Kohatsu, Portland, OR (US); Alexandre Baudouin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 175 days.

This patent is subject to a terminal disclaimer.

(21) Appl. No.: 14/468,834

(22) Filed: Aug. 26, 2014

(65) Prior Publication Data

US 2014/0360050 A1 Dec. 11, 2014

Related U.S. Application Data

(63) Continuation of application No. 12/895,442, filed on Sep. 30, 2010, now Pat. No. 8,857,077.

(51) Int. Cl.

| | |
|---|---|
| ***A43C 11/00*** | (2006.01) |
| ***A43B 23/02*** | (2006.01) |
| ***A43B 3/26*** | (2006.01) |
| ***A43B 5/00*** | (2006.01) |
| ***A43B 7/14*** | (2006.01) |
| ***A43B 7/18*** | (2006.01) |
| ***A43C 1/04*** | (2006.01) |
| ***A43C 11/14*** | (2006.01) |

(52) U.S. Cl.

CPC ..... *A43B 23/0245* (2013.01); *A43B 3/26* (2013.01); *A43B 5/00* (2013.01); *A43B 7/1495* (2013.01); *A43B 7/18* (2013.01); *A43C 1/04* (2013.01); *A43C 11/008* (2013.01); *A43C 11/1493* (2013.01)

(58) Field of Classification Search

CPC ..... A43C 1/003; A43C 1/006; A43C 1/00; A43C 1/04; A43C 11/008; A43C 11/1493; A43B 23/0245; A43B 5/00; A43B 7/1495; A43B 7/18; A43B 3/26

USPC ..... 36/50.1, 50.5, 58.5, 58.6, 170, 89, 91

See application file for complete search history.

(56) References Cited

U.S. PATENT DOCUMENTS

| | | | |
|---|---|---|---|
| 643,998 | A | 2/1900 | Batchelor |
| 744,798 | A | 11/1903 | Roberts |
| 811,316 | A | 1/1906 | McPherson |

(Continued)

FOREIGN PATENT DOCUMENTS

| | | | |
|---|---|---|---|
| CH | 678794 | A5 | 11/1991 |
| CN | 1163081 | A | 10/1997 |

(Continued)

OTHER PUBLICATIONS

Communication in EP11752425.6 dated Oct. 6, 2015.

(Continued)

*Primary Examiner* — Katharine Gracz

(74) *Attorney, Agent, or Firm* — Banner & Witcoff, Ltd.

(57) ABSTRACT

An article of footwear may include one or more harnesses to restrain a wearer foot from transverse movement within an upper during a rapid sideways maneuver. One harness may be located in a lateral forefoot region. Another harness may be located in medial region and may include a midfoot and/or a hindfoot region.

17 Claims, 12 Drawing Sheets

(56) References Cited

U.S. PATENT DOCUMENTS 1,545,623 A * 7/1925 Westfall ..... A43B 5/02 36/89
1,649,173 A 11/1927 McDonough
1,845,031 A 2/1932 Gilbert
2,038,151 A 4/1936 Wernmark
2,090,675 A 8/1937 Hadaway
2,091,434 A 8/1937 Davis
2,112,884 A 4/1938 Gillette et al.
2,149,664 A 3/1939 Brown et al.
2,182,843 A 12/1939 Flynn et al.
2,191,210 A 2/1940 Johnson
2,259,273 A 10/1941 Smith
2,367,092 A 1/1945 Blotner
2,389,148 A 11/1945 Grebow
2,451,372 A 10/1948 Ballenger
2,539,026 A 1/1951 Mangold
2,539,761 A * 1/1951 Whitman ..... A43C 1/00 36/114
2,590,648 A 3/1952 Pitz
2,642,677 A 6/1953 Yates
2,660,812 A 12/1953 Henke
2,680,309 A 6/1954 Peterson
2,933,834 A 4/1960 Bourland
3,001,302 A 9/1961 Farley
3,066,678 A 12/1962 Riecken
D205,993 S 10/1966 Ali
3,327,410 A 6/1967 Herbert et al.
3,352,033 A 11/1967 Colley
D217,217 S 4/1970 Evins
3,522,668 A 8/1970 Fesl
3,597,862 A 8/1971 Vogel
3,678,604 A 7/1972 Levine
3,977,098 A 8/1976 Chalmers
4,079,527 A 3/1978 Antonious
4,114,297 A 9/1978 Famolare, Jr.
4,142,307 A 3/1979 Martin
4,200,997 A 5/1980 Scheinhaus et al.
D255,396 S 6/1980 Scheinhaus et al.
4,282,657 A 8/1981 Antonious
4,282,659 A 8/1981 Bourque et al.
4,296,558 A 10/1981 Antonious
4,428,130 A 1/1984 Perotto
4,446,633 A 5/1984 Scheinhaus et al.
4,476,639 A 10/1984 Zaccaria
4,513,520 A 4/1985 Koch
4,547,981 A 10/1985 Thais et al.
4,577,421 A 3/1986 Sartor
4,592,154 A 6/1986 Oatman
4,616,524 A 10/1986 Bidoia
4,620,378 A 11/1986 Sartor
4,624,064 A 11/1986 Pozzebon
4,644,671 A 2/1987 Walkhoff
4,679,334 A 7/1987 McBride
4,698,922 A 10/1987 Sartor
4,719,709 A 1/1988 Vaccari
RE32,585 E 2/1988 Antonious
4,724,626 A 2/1988 Baggio
4,766,682 A 8/1988 Malloy, III
4,811,498 A 3/1989 Barret
4,811,500 A 3/1989 Maccano
4,811,503 A 3/1989 Iwama
4,817,302 A 4/1989 Saltsman
4,869,000 A 9/1989 York, Jr.
4,878,504 A 11/1989 Nelson
4,901,451 A 2/1990 Cumin
4,922,630 A 5/1990 Robinson
4,926,569 A 5/1990 Bunch
4,972,613 A 11/1990 Loveder
5,056,241 A 10/1991 Young
5,269,078 A 12/1993 Cochrane
5,323,549 A 6/1994 Segel et al.
5,386,649 A 2/1995 Paris
5,400,529 A 3/1995 Bell et al.
5,477,593 A 12/1995 Leick
5,499,461 A 3/1996 Danezin et al.
5,509,217 A 4/1996 Condini
5,544,433 A 8/1996 Borsoi et al.
5,566,474 A 10/1996 Leick et al.
5,575,015 A 11/1996 Paris et al.
5,692,320 A * 12/1997 Nichols ..... A43C 1/04 36/170
5,701,689 A 12/1997 Hansen et al.
5,704,138 A 1/1998 Donnadieu
5,724,680 A 3/1998 Cesnick et al.
5,771,608 A 6/1998 Peterson
5,775,006 A 7/1998 Breuner
5,819,439 A * 10/1998 Sanchez ..... A43B 5/00 36/50.1
5,836,094 A 11/1998 Figel
5,906,058 A 5/1999 Rench et al.
5,933,987 A 8/1999 Demarchi
5,937,542 A 8/1999 Bourdeau
5,937,543 A 8/1999 Hall et al.
5,966,841 A 10/1999 Barret
5,992,057 A 11/1999 Monti
6,021,585 A 2/2000 Cole
6,021,589 A 2/2000 Cagliari et al.
6,076,285 A 6/2000 Caeran et al.
6,138,384 A 10/2000 Messmer
6,151,804 A * 11/2000 Hieblinger ..... A43B 5/00 36/128
6,170,175 B1 1/2001 Funk
6,226,898 B1 5/2001 Trimble et al.
6,237,254 B1 5/2001 Rork et al.
6,272,772 B1 8/2001 Sherman
6,276,708 B1 8/2001 Hogstedt
6,295,743 B1 10/2001 Brooks
6,393,733 B1 5/2002 London et al.
6,405,457 B1 6/2002 Basso et al.
6,467,193 B1 10/2002 Okajima
6,467,195 B2 10/2002 Pierre et al.
6,499,234 B2 12/2002 Manzi
6,505,424 B2 * 1/2003 Oorei ..... A43B 5/00 36/129
6,543,157 B2 4/2003 Pan
6,543,159 B1 * 4/2003 Carpenter ..... A43B 3/0073 36/115
6,560,898 B2 5/2003 Borsoi et al.
6,606,803 B1 8/2003 Ritter et al.
6,606,804 B2 8/2003 Kaneko et al.
6,637,130 B2 10/2003 Urie et al.
6,701,644 B2 3/2004 Oorei et al.
6,732,455 B2 5/2004 Bordin et al.
6,772,540 B2 8/2004 Delgorgue et al.
6,792,702 B2 9/2004 Borsoi et al.
6,796,056 B2 9/2004 Swigart
6,860,035 B2 3/2005 Girard
6,877,256 B2 4/2005 Martin et al.
6,877,257 B2 4/2005 Delgorgue et al.
6,925,734 B1 8/2005 Schaeffer
6,935,054 B2 8/2005 Hall et al.
6,952,891 B2 * 10/2005 Hirayama ..... A43B 5/0405 36/10
6,954,996 B2 10/2005 Borsoi
6,993,859 B2 2/2006 Martin et al.
7,010,823 B2 3/2006 Baek
7,082,701 B2 8/2006 Dalgaard et al.
7,086,181 B2 8/2006 Farys
7,103,993 B2 9/2006 Sakai
7,134,224 B2 11/2006 Elkington et al.
7,159,340 B2 * 1/2007 Borsoi ..... A43B 5/0405 36/10
7,200,957 B2 4/2007 Hubbard et al.
7,219,444 B2 5/2007 Hall
7,243,444 B2 7/2007 Selner
7,281,341 B2 10/2007 Reagan et al.
7,293,373 B2 11/2007 Reagan et al.
7,343,701 B2 3/2008 Pare et al.
7,377,058 B2 5/2008 Elkington et al.
7,386,947 B2 6/2008 Martin et al.
7,392,990 B2 7/2008 Bussiere
7,401,423 B2 7/2008 Reagan et al.
7,437,837 B2 10/2008 Jacobs
7,546,698 B2 6/2009 Meschter

(56) References Cited

U.S. PATENT DOCUMENTS

| | | | | |
|---|---|---|---|---|
| 7,574,818 | B2 | 8/2009 | Meschter | |
| 8,122,616 | B2 | 2/2012 | Meschter et al. | |
| 8,132,340 | B2 | 3/2012 | Meschter | |
| 8,266,827 | B2 | 9/2012 | Dojan et al. | |
| 8,302,329 | B2 | 11/2012 | Hurd et al. | |
| 8,312,645 | B2 | 11/2012 | Dojan et al. | |
| 8,312,646 | B2 | 11/2012 | Meschter et al. | |
| 8,388,791 | B2 | 3/2013 | Dojan et al. | |
| 8,418,380 | B2 | 4/2013 | Dojan et al. | |
| 2001/0015023 | A1 | 8/2001 | Funk | |
| 2001/0018805 | A1 | 9/2001 | Basso | |
| 2002/0088144 | A1* | 7/2002 | Katz | A43C 11/14 36/88 |
| 2002/0095750 | A1 | 7/2002 | Hammerslag | |
| 2002/0148142 | A1* | 10/2002 | Oorei | A43B 5/00 36/129 |
| 2002/0174568 | A1 | 11/2002 | Neiley | |
| 2003/0066207 | A1 | 4/2003 | Gaither | |
| 2003/0154627 | A1 | 8/2003 | Hirayama | |
| 2003/0167655 | A1* | 9/2003 | Sussmann | A43C 11/008 36/50.1 |
| 2003/0172550 | A1 | 9/2003 | Balconi et al. | |
| 2004/0181972 | A1* | 9/2004 | Csorba | A43B 7/1495 36/50.1 |
| 2004/0244221 | A1 | 12/2004 | Hall et al. | |
| 2006/0117606 | A1 | 6/2006 | Chen et al. | |
| 2006/0174516 | A1 | 8/2006 | Peruzzo et al. | |
| 2006/0191164 | A1 | 8/2006 | Dinndorf et al. | |
| 2007/0033836 | A1* | 2/2007 | Rasmussen | A43C 11/1493 36/50.1 |
| 2007/0169377 | A1 | 7/2007 | Neiley | |
| 2007/0169378 | A1 | 7/2007 | Sodeberg et al. | |
| 2007/0271821 | A1 | 11/2007 | Meschter | |
| 2007/0277398 | A1* | 12/2007 | Davis | A43B 1/0081 36/50.1 |
| 2008/0022554 | A1 | 1/2008 | Meschter et al. | |
| 2008/0028641 | A1 | 2/2008 | Messmer | |
| 2008/0168685 | A1 | 7/2008 | Kim et al. | |
| 2008/0235995 | A1 | 10/2008 | Reagan et al. | |
| 2008/0250667 | A1 | 10/2008 | Rasmussen et al. | |
| 2008/0276489 | A1 | 11/2008 | Meschter | |
| 2009/0077831 | A1 | 3/2009 | Mazzarolo et al. | |
| 2009/0100717 | A1 | 4/2009 | Cabanis | |
| 2009/0133287 | A1 | 5/2009 | Meschter | |
| 2010/0043253 | A1 | 2/2010 | Dojan et al. | |
| 2011/0197475 | A1* | 8/2011 | Weidl | A43B 1/0009 36/107 |
| 2011/0258876 | A1* | 10/2011 | Baker | A43C 11/008 36/50.1 |
| 2012/0079741 | A1 | 4/2012 | Kohatsu | |
| 2012/0124866 | A1* | 5/2012 | Moriyasu | A43B 7/1495 36/83 |

FOREIGN PATENT DOCUMENTS

| | | | |
|---|---|---|---|
| CN | 1792291 | A | 6/2006 |
| DE | 3506057 | A1 | 2/1986 |
| DE | 3900777 | A1 | 7/1990 |
| DE | 4129270 | A1 | 3/1993 |
| EP | 99504 | A1 | 2/1984 |
| EP | 132744 | A1 | 2/1985 |
| EP | 0585593 | A1 | 3/1994 |
| EP | 0623295 | A1 | 11/1994 |
| EP | 0842619 | | 5/1998 |
| EP | 0948910 | A2 | 10/1999 |
| EP | 995363 | A1 | 4/2000 |
| EP | 1013185 | A1 | 6/2000 |
| EP | 1110466 | A2 | 6/2001 |
| EP | 1308104 | A2 | 5/2003 |
| EP | 1457124 | A1 | 9/2004 |
| EP | 1486131 | A1 | 12/2004 |
| EP | 1495691 | A1 | 1/2005 |
| EP | 1308104 | B1 | 7/2005 |
| EP | 1787539 | A1 | 5/2007 |
| EP | 1882420 | A1 | 1/2008 |
| FR | 2496423 | A1 | 6/1982 |
| FR | 2534116 | A1 | 4/1984 |
| FR | 2586905 | A1 | 3/1987 |
| FR | 2621462 | A2 | 4/1989 |
| FR | 2716350 | A1 | 8/1995 |
| FR | 2754981 | A1 | 4/1998 |
| FR | 2830418 | A1 | 4/2003 |
| FR | 2834182 | A1 | 7/2003 |
| FR | 2844683 | A1 | 3/2004 |
| GB | 336807 | A | 10/1930 |
| JP | 1080303 | | 9/1987 |
| JP | 1148201 | | 10/1988 |
| JP | 2180201 | | 11/1989 |
| JP | 8010002 | | 6/1994 |
| JP | 2007136185 | A | 6/2007 |
| JP | 2008029826 | A | 2/2008 |
| NL | 1029423 | A1 | 10/2005 |
| WO | 9408478 | A1 | 4/1994 |
| WO | 9939599 | A1 | 8/1999 |
| WO | 02076254 | A1 | 10/2002 |
| WO | 2007046160 | A1 | 4/2007 |
| WO | 20090137662 | A2 | 11/2009 |

OTHER PUBLICATIONS

First Office Action in CN201480004376.8 dated Jan. 19, 2016, with English translation.

First Office Action in CN201180047334.9 dated Aug. 29, 2014, with English translation.

International Search Report and Written Opinion for PCT/US2011/049368 dated Jan. 9, 2012.

International Search Report and Written Opinion for PCT/US2014/010883 dated Apr. 16, 2014.

* cited by examiner

FOOTWEAR WITH INTERNAL HARNESS

CROSS-REFERENCE TO RELATED APPLICATION

This application is a continuation of U.S. patent application Ser. No. 12/895,442, filed Sep. 30, 2010, and titled "Footwear with Internal Harness." Application Ser. No. 12/895,442, in its entirety, is incorporated by reference herein.

BACKGROUND

During the play of various sports, as well as in the context of various non-athletic activities, a person may rapidly alter motion so as to move in a sideways direction. In basketball and various other sports, for example, a player may frequently change direction of movement (or commence moving) by "cutting" quickly to one side. During such rapid sideways maneuvers, a person may push on the lateral side of one foot (i.e., the right foot when cutting left, the left foot when cutting right). That person may also (or alternatively) push against the medial side of the other foot (i.e., left foot when cutting left, right foot when cutting right).

To avoid performance degradation and/or injury in activities that involve rapid sideways maneuvers, a shoe designed for such activities should constrain a wearer's foot from unnecessary motion within the shoe. Conventionally, such constraint has been achieved by cinching laces and/or external straps to tighten the shoe upper. If the sole structure of the shoe is appropriately sized relative to the wearer's foot, the tightened upper can then prevent (or at least restrict) movement of the foot relative to the sole structure. Stabilizing a foot relative to a sole structure can provide significant performance and safety benefits.

In many cases, however, simply tightening an upper is insufficient to prevent a foot from moving across an underfoot platform. For example, a sole structure may have a footbed that is slightly wider than an optimum width for a particular wearer's foot. This is often the case for persons with narrow feet. If a sole structure underfoot platform is slightly wide for a particular wearer, there may be excess space between the sides of a wearer foot and the sides of the footbed. Under such circumstances, tightening laces or otherwise tightening the upper (even to a point that may cause discomfort) may not conform the upper to the wearer foot in regions adjacent to the footbed edges. In particular, such tightening will generally not pull the upper away from a "bite line" along which the upper is joined to an underfoot platform. If the upper does not fully conform to the wearer foot, gaps between the side of a wearer foot and the bite line can remain after the upper has been fully cinched. These gaps then provide room for the foot to move across the footbed during rapid sideways maneuvers.

SUMMARY

This Summary is provided to introduce a selection of concepts in a simplified form that are further described below in the Detailed Description. This Summary is not intended to identify key or essential features of the invention.

In at least some embodiments, an article of footwear may include one or more harnesses that restrain a wearer foot from transverse movement within an upper during a rapid sideways maneuver. In some embodiments, one such harness may be located in a lateral forefoot region of shoe. In other embodiments, such a harness may be located in medial region of a shoe, which medial region may include a midfoot and/or a hindfoot region. In still other embodiments, a shoe may include a first harness located in a lateral forefoot region and a second harness located in a medial region.

A harness may include one or more straps and/or substraps. The harness may further include an anchor portion, a pulling portion, a wrapping portion and a fixed portion. The anchor portion may be attached to at least one of the upper and the sole structure. The fixed portion may be fixed relative to the sole structure at a location inward from an edge of the sole structure. The pulling portion may be located between the anchor and fixed portions. The wrapping portion may be located between the pulling and fixed portions, may be unattached to the upper or to the sole structure, and may be located in the interior of the upper. In response to a pulling force exerted on the pulling portion, the wrapping portion may conform to a bottom and side of a wearer foot and without being limited by the bite line.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1A:
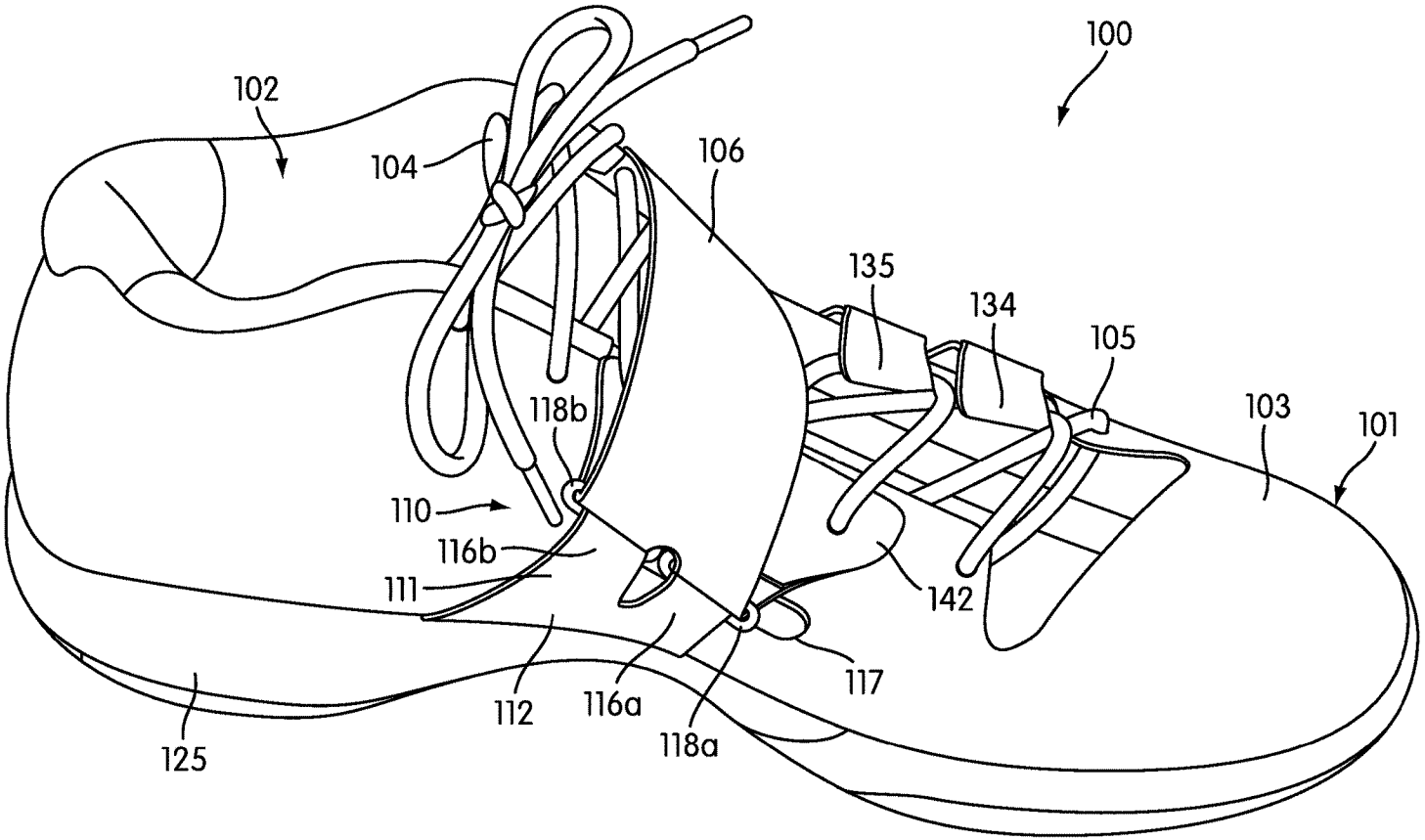
FIG. 1A is a front medial perspective view of an article of footwear according to some embodiments.

In at least some embodiments, and as described in more detail herein, an article of footwear may include one or more internal harness structures. These structures can include a network of straps that extend within an interior of the upper and that can be tightened so as to conform to a wearer's foot. Once tightened, these straps help to contain the foot on the underfoot platform of a sole structure and reduce excess sideways movement of the wearer's foot relative to the shoe footbed.

The locations of certain regions in a shoe and in components of a shoe according to at least some embodiments may be described with reference to human foot anatomy. Specifically, various regions may be described using foot bones of a person wearing a shoe that is appropriately sized for the wearing foot. A shoe may be considered "appropriately sized" if the outer edges of the wearer's foot fit within an interior of a foot-containing cavity of the upper according to conventionally-accepted tolerances for the type of shoe in question.

A "forefoot" region of a shoe will generally correspond to the metatarsal and phalangeal bones of a shoe wearer's foot and will extend beyond the wearer's toes to the frontmost portion of the shoe. A "midfoot" region will generally correspond to the cuboid, navicular, medial cuneiform, intermediate cuneiform and lateral cuneiform bones of the wearer's foot. A "hindfoot" region extends from the midfoot region to the rearmost portion of the shoe and corresponds to bones that include the wearer calcaneus (heel bone). The terms "plantar," "lateral" and "medial" have their conventional meanings with regard to description of human foot anatomy.

Unless clearly indicated otherwise, "top" and "bottom" generally refer to relative locations that assume a shoe is resting upright on a flat horizontal surface. For example, a bottom of a sole structure may refer to the outer surface of the sole structure that is intended to contact the ground. A "forward" direction is a direction toward the frontmost portion of a shoe. A "rearward" direction is a direction toward the rearmost portion of the shoe. A "transverse" direction is a horizontal direction across a shoe, and can be forward, rearward, medial, lateral, or some direction with both forward (or rearward) and medial (or lateral) components. "Longitudinal" refers to directions along an axis extending through the front-to-rear centerline of a shoe or of a shoe wearer's foot. "Inward" refers to a transverse direction toward a front-to-rear centerline of a shoe or of a shoe wearer's foot. "Outward" refers to a transverse direction away from a front-to-rear centerline of a shoe or of a shoe wearer's foot.

FIGS. 1A-1E show several views of a shoe 100 according to at least some embodiments. Shoe 100 is intended for wear by a basketball player. However, other embodiments include shoes intended for wear during other athletic and/or non-athletic activities. Shoe 100 is intended for a wearer's left foot. Shoe 100 is part of a pair that includes a right foot shoe (not shown) that is a mirror image of shoe 100.

FIG. 1A is a medial perspective view of a shoe 100. Shoe 100 includes an upper 101 configured to receive the foot of a wearer through an ankle opening 102. Upper 101 includes a shell 103, a tongue 104 and a lasting sock (or Strobel) element. The lasting sock of upper 101 is not visible in FIGS. 1A-1E, but is shown in FIGS. 2-4, 6 and 7. Shell 103, tongue 104 and the lasting sock define an interior region of upper 101. Upper 101 can be tightened about an inserted wearer foot using lace 105 and exterior strap 106. Shell 103 is generally continuous and may have edges (not shown) that are stitched together at a rear seam of upper 101 in a conventional manner. With tongue 104, shell 103 substantially encloses the sides and tops of a wearer's foot within the interior of upper 101. In other embodiments, an upper may include openings and/or mesh panels on side and/or top surfaces.

Figure 1B:
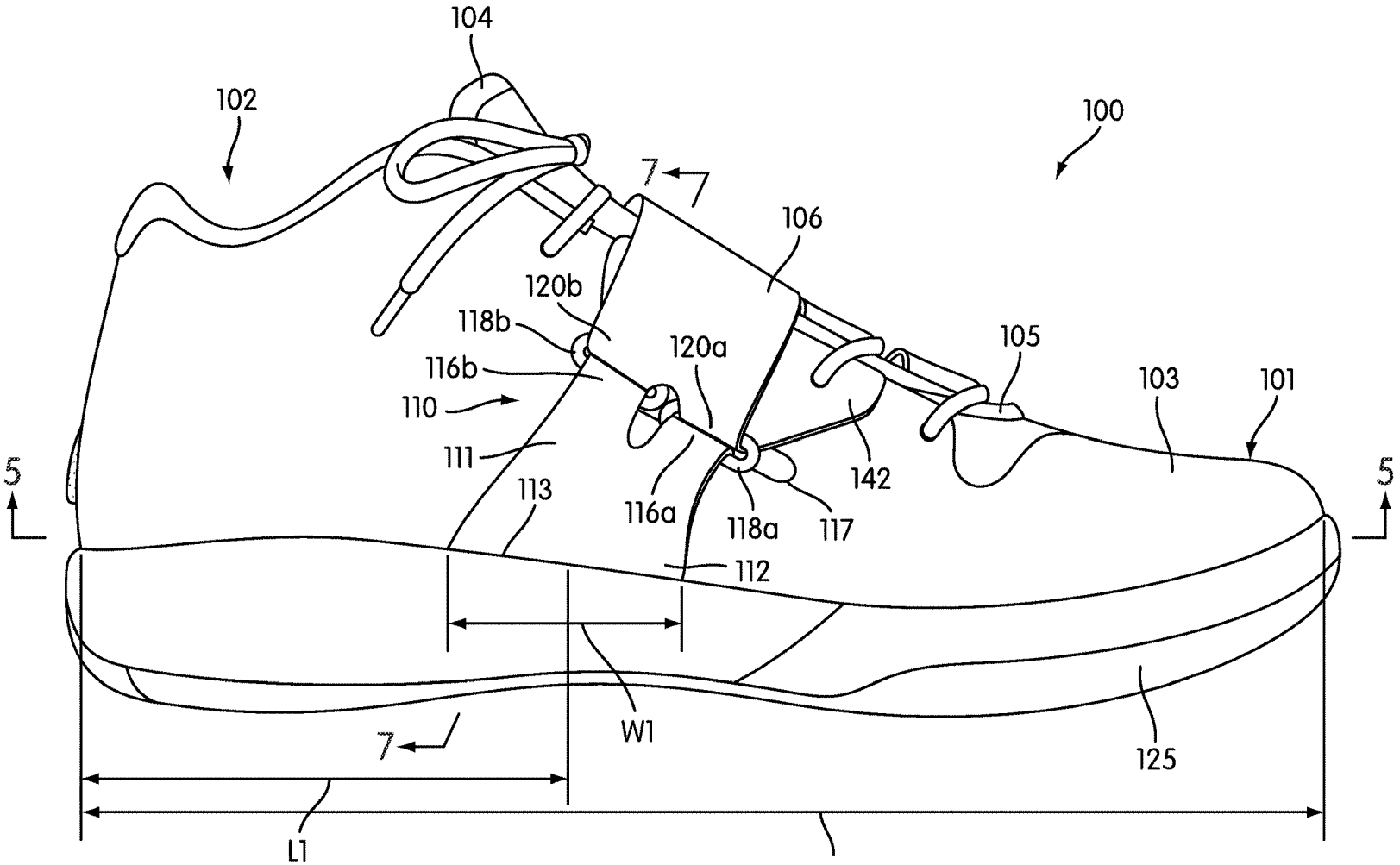
FIG. 1B is a medial side view of the article of footwear of FIG. 1A.

FIG. 1B is a medial side view of shoe 100. Also visible in FIGS. 1A and 1B is a portion of a midfoot harness 110. Midfoot harness 110 includes a main strap 111. An anchor portion 112 of main strap 111 is attached to upper 101 on the outside of shell 103. In some embodiments, a base end 113 of anchor portion 112 has a longitudinal location that is approximately aligned with a wearer's navicular and medial cuneiform bones. In some such embodiments, the longitudinal distance L1 from the rearmost portion of the upper 101 lasting sock to the center of base end 113 is 45-50% of the longitudinal length L of the lasting sock. In at least some embodiments, base end 113 has a longitudinal width that is approximately 50 to 60 millimeters (mm) for a U.S. men's size 9 shoe.

Main strap 111 branches into a forward substrap **116*a* and a rear substrap 116*b*. Only portions of substraps 116*a* and 116*b* are visible in FIG. 1A. As explained in more detail below, substraps 116*a* and 116*b* extend through an opening 117 in shell 103 and under an insole and liner located within the interior of upper 101. Although not shown in FIGS. 1A and 1B, each of substraps 116*a* and 116*b* has an end secured to the lasting sock of upper 101. As further discussed in connection with subsequent figures, connecting portions of harness 110 that extend between anchor portion 112 and the fixed ends of substraps 116*a* and 116*b* are not attached to shell 103** or to the lasting sock.

As further shown in FIGS. 1A and 1B, substraps **116*a* and 116*b* respectively pass through rings 118*a* and 118*b*. Also passing through ring 118*a* is a substrap 120*a* of external strap 106. Similarly, another substrap 120*b* of strap 106 passes through ring 118*b*. In this manner, and as further explained below, strap 106 is coupled to midfoot harness 110 and can be used to tighten harness 110** so as to conform to a wearer foot.

Upper 101 is bonded to a sole structure 125. Embodiments include shoes having sole structures of numerous widely varying types. A sole structure in some embodiments may be, e.g., a synthetic rubber element molded as a single piece. In other embodiments, a sole structure may include multiple components that have been sequentially molded or otherwise bonded together. For example, a sole structure may include a midsole formed from a first material (e.g., foamed ethylene vinyl acetate) bonded to an outsole formed from different materials (e.g., synthetic rubber). A sole structure could also include one or more fluid-filled cushions, a stiffening plate or other support element(s), traction elements (e.g., cleats), etc. For convenience, and because of differing internal details of sole structures according to various embodiments, sole structure 125 is treated as a single unitary component throughout the drawing figures.

Figure 1C:
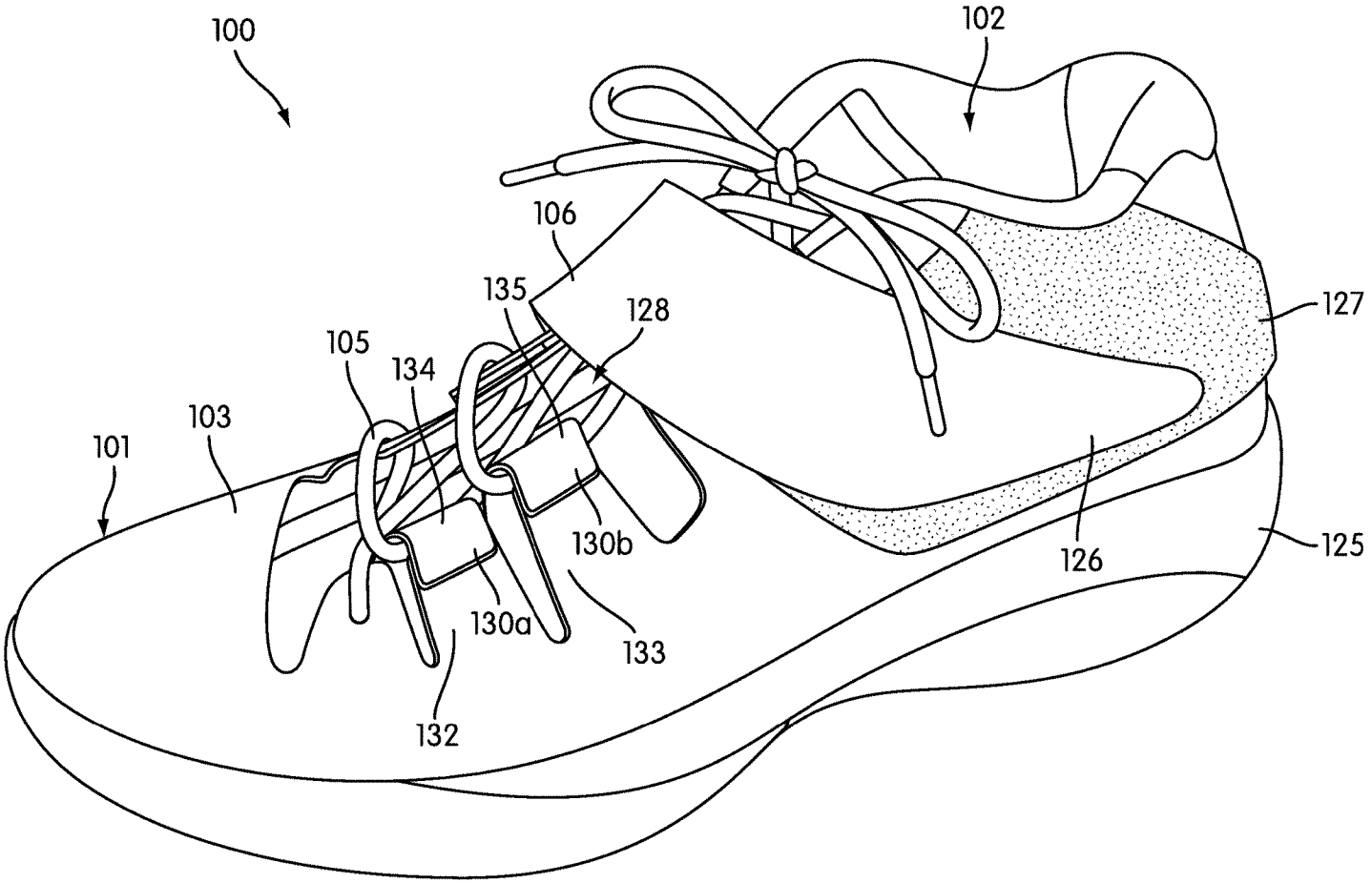
FIG. 1C is a front lateral perspective view of the article of footwear of FIG. 1A.

FIG. 1C is a lateral perspective view of shoe 100. In some embodiments, hook and pile fastening material (e.g., such as is available under the trade name VELCRO) is used to secure a free end 126 of external strap 106 to shell 103. Portions of the lateral midfoot and hindfoot regions of shell 103 have an attached panel 127 of pile material. A panel of hook material (not shown) is attached to the underside of a free end 126 of external strap 106. A wearer of shoe 101 can pull free end 126 across tongue opening 128 to tighten strap 106. The wearer can then secure strap 106 in that tightened condition by pressing the underside of free end 126 against panel 127 while maintaining tension on strap 106.

Figure 1D:
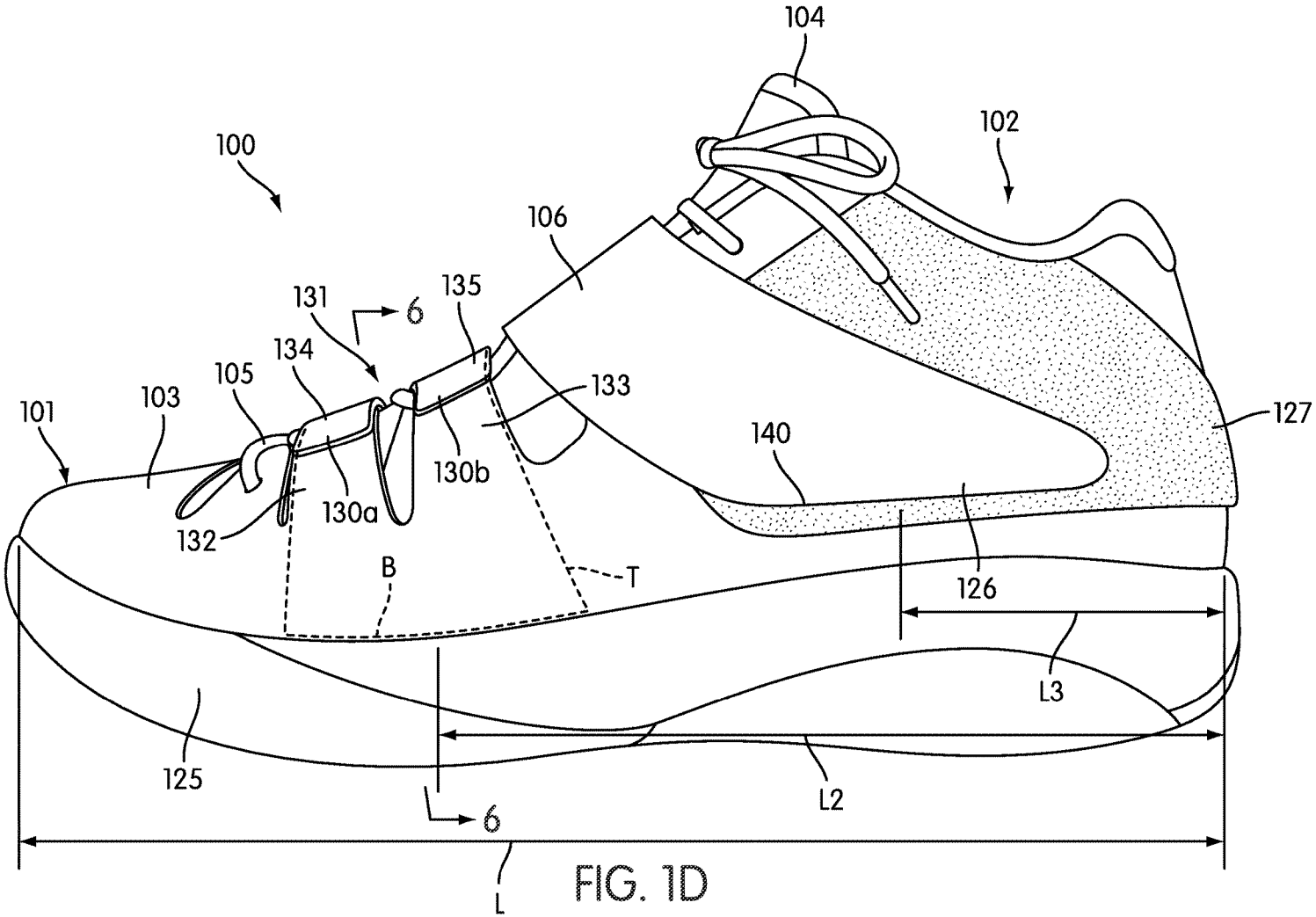
FIG. 1D is a lateral side view of the article of footwear of FIG. 1A.

FIG. 1D is a lateral side view of shoe 100. Visible in FIGS. 1C and 1D are anchor portions **130*a* and 130*b* of a forefoot harness 131. Anchor portion 130*a* is attached to a tab 132 of shell 103 to form a lacing loop 134. Anchor portion 130*b* is attached to a tab 133 of shell 103 to form a lacing loop 135. When lace 105 is threaded through loops 134 and 135 and through other loops (or eyes), tightening of lace 105 results in tightening of forefoot harness 131 and conformance of harness 131 to a wearer's foot. Additional aspects of forefoot harness 131** are also described below.

A roughly trapezoidal shape T is formed by a front edge of tab 132, a rear edge of tab 133, and a horizontal base line B that generally follows an interface between shell 103 and sole structure 125. In at least some embodiments, the rear end of base B has a longitudinal location that is approximately aligned with a wearer's fifth metatarsal-phalangeal joint. In at least some of those embodiments, the front end of base B has a longitudinal location that is approximately aligned with a wearer's third metatarsal-phalangeal joint. A longitudinal distance L2 from the rearmost portion of the upper 101 lasting sock to the center of base B is 60-80% of the longitudinal length L of the lasting sock.

FIG. 1D further shows a location for strap 106 after tightening. In the embodiment of shoe 100, pile panel 127 is sized so as to provide a wearer with a wide range of locations to secure end 126 of strap 106. In some embodiments, however, panel 127 and strap 106 are arranged so that at least one of those securing locations is as shown in FIG. 1D. In particular, strap 106 is secured such that an edge 140 of end 126 is roughly centered under a wearer's lateral malleolus. A longitudinal distance L3 from the rearmost portion of the upper 101 lasting sock to the center of edge 140 is 25-30% of the longitudinal length L of the lasting sock.

Figure 1E:
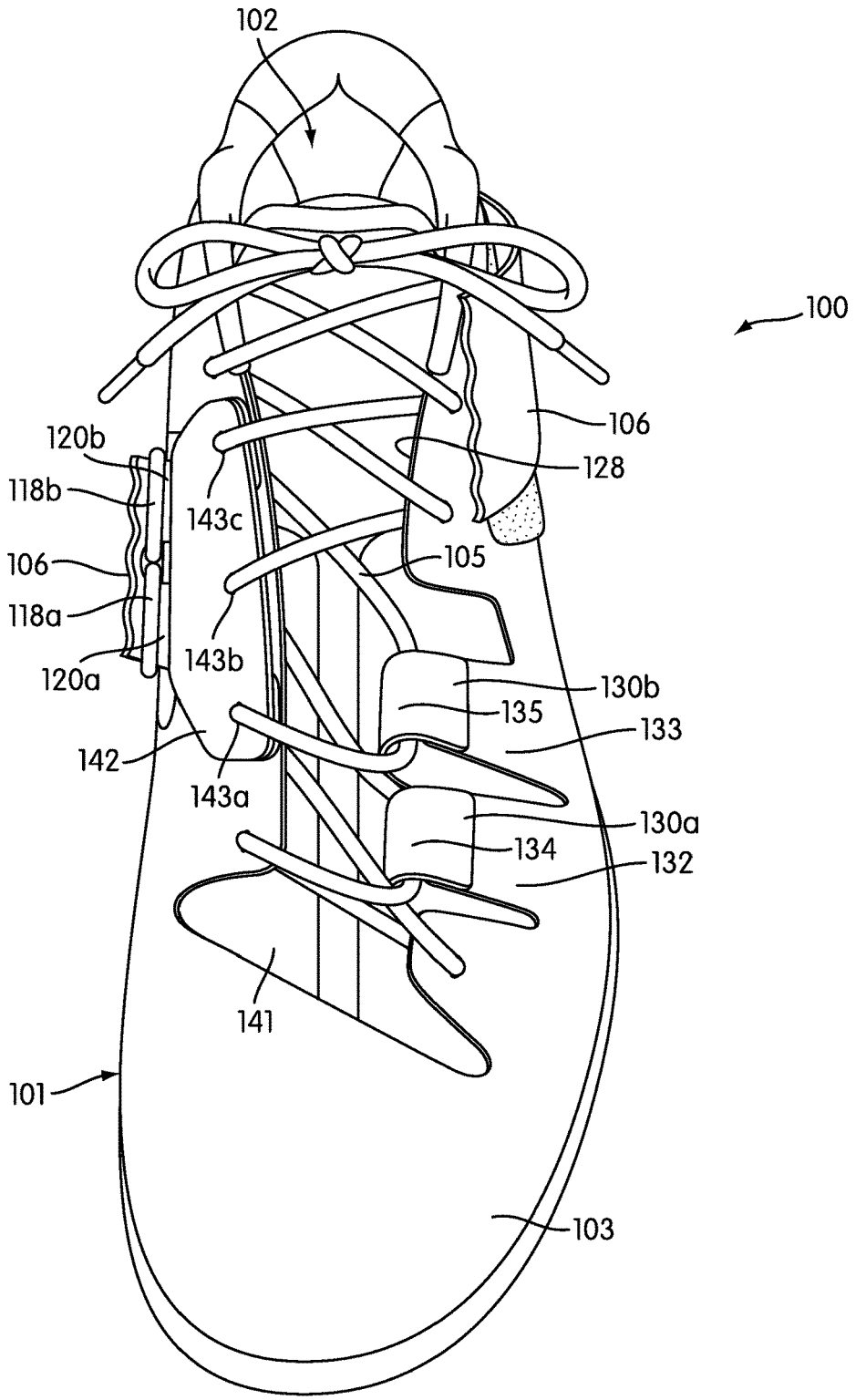
FIG. 1E is a front perspective view of the article of footwear of FIG. 1A.

FIG. 1E is a front perspective view of shoe 100. A portion of external strap 106 has been removed to reveal certain details that are obscured when strap 106 is secured in place. Shell 103 has a tongue opening 128. Portions of tongue 104 and/or a bootie-type liner 141 cover a wearer foot in the region of opening 128. In at least some embodiments, portions of tongue 104 extend under and are bonded to liner 141. As shown in more detail in FIGS. 6 and 7, liner 141 forms a bootie shape that substantially envelops a wearer foot.

Strap 106 includes an end 142 having three lacing eyes 143*a*-143*c* formed therein. Each of eyes 143*a*-143*c* corresponds to a separate lacing eye formed in shell 103 along the medial edge of tongue opening 128. Lace 105 is threaded through each of eyes 143*a*-143*c* and its corresponding eye in shell 103. In this manner, tightening of lace 105 secures strap end 142 in place. Conversely, tightening of strap 106 helps to further tighten lace 105 after lace 105 has been tied. In at least some embodiments, eyes 143*a*-143*c* may be punched and have diameters of approximately 3.5 mm. Corresponding eyes in shell 103 may also be punched and may have diameters of approximately 4.5 mm.

Substraps 120*a* and 120*b* of strap 106 are attached to strap end 142. Substrap 120*a* is threaded through ring 118*a* and substrap 120*b* is threaded through ring 118*b*. Substraps 120*a* and 120*b* are doubled over to form loops when strap 106 is folded across tongue opening 128. When strap end 142 is secured in place by lace 105 and strap 106 is tightened, and as discussed in more detail in connection with FIG. 7, those loops pull on rings 118*a* and 118*b*. In turn, rings 118*a* and 118*b* pull on loops formed by the folded over portions of harness 110 substraps 116*a* and 116*b*.

Figure 2:
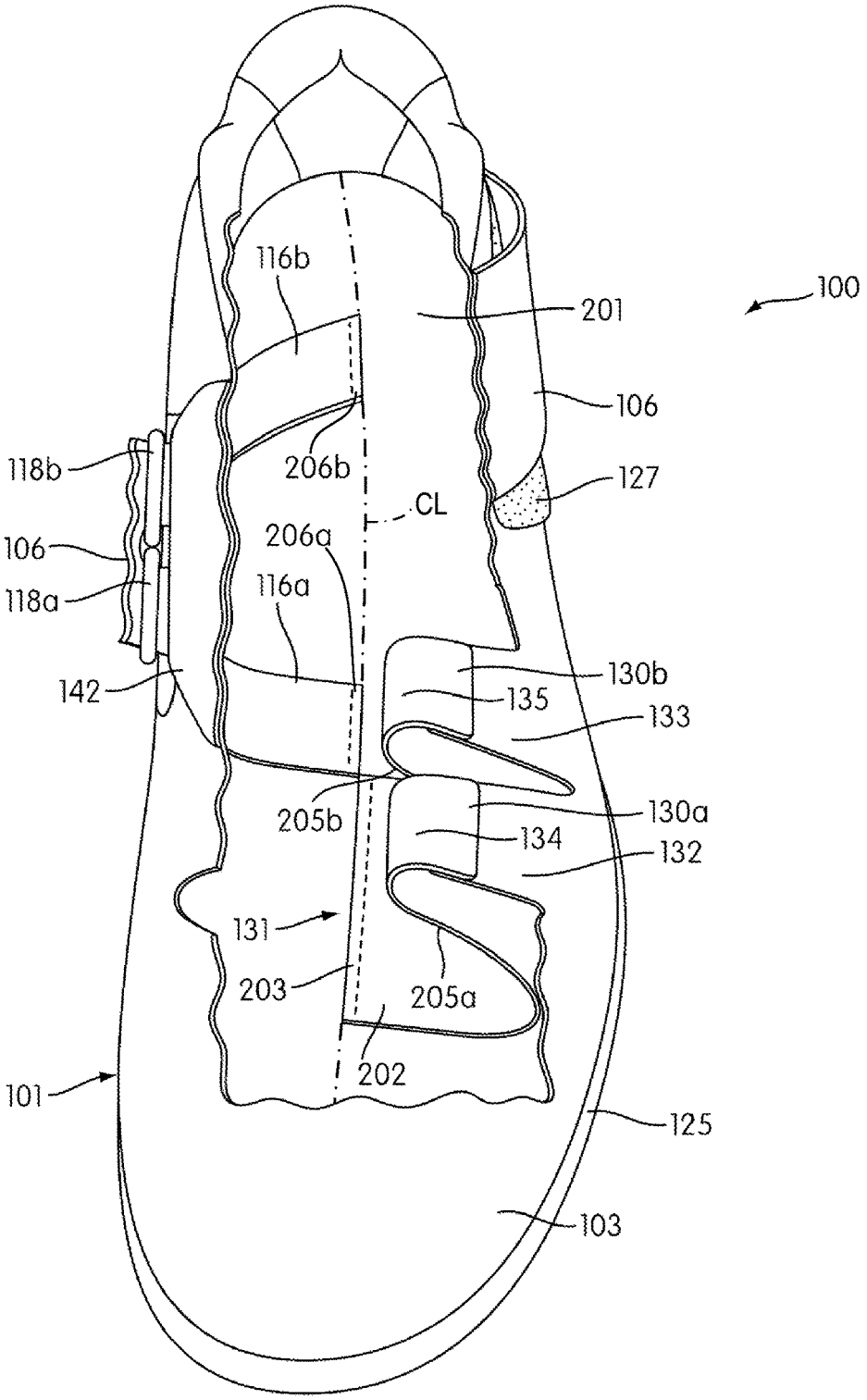
FIG. 2 is a front perspective view of the article of footwear of FIG. 1A, and with portions of the article removed to show certain internal details.

FIG. 2 is a top perspective view of shoe 100 in which certain portions have been removed to reveal selected internal details. In particular, tongue 104 and lace 105 are omitted from FIG. 2, and portions of shell 103 surrounding tongue opening 131 have also be removed. Also omitted from FIG. 2 are liner 141 and an insole contained within the interior of upper 101. The insole is described in connection with FIG. 6. FIG. 2 shows lasting sock 201. Lasting sock 201 is attached to bottom edges of shell 103 so as to partially define the interior of upper 101.

As seen in FIG. 2, forefoot harness 131 includes a main strap 202 having an end 203. In some embodiments, end 203 has a longitudinal width that is approximately 60 mm for a U.S. men's size 9 shoe. End 203 is secured to lasting sock 201 so as to form a fixed portion of harness 131. In some embodiments, end 203 is stitched or otherwise fixed to lasting sock 201 at a location that approximately lies along a longitudinal centerline CL of shoe 100. Main strap 202 branches into substraps 205*a* and 205*b*. Substrap 205*a* terminates in anchor portion 130*a* attached to tab 132. Substrap 205*b* terminates in anchor portion 130*b* attached to tab 133. Connecting portions of harness 131 that extend between fixed end 203 and anchor portions 130*a* and 130*b* are not attached to shell 103 or to lasting sock 201.

FIG. 2 further shows the positions for substraps 116*a* and 116*b* of midfoot harness 110. Substrap 116*a* angles forward from opening 117 (not shown in FIG. 2) and has an end 206*a* fixed to lasting sock 201. Substrap 206*b* angles rearward from opening 117 and has an end 206*b* that is also fixed to lasting sock 201. In some embodiments, ends 206*a* and 206*b* are stitched or otherwise fixed to lasting sock 201 at locations that approximately lie along the longitudinal centerline CL of shoe 100. Connecting portions of harness 110 that extend between fixed ends 206*a* and 206*b* and anchor portion 112 (FIGS. 1A and 1B) are not attached to shell 103 or to lasting sock 201.

Figure 3:
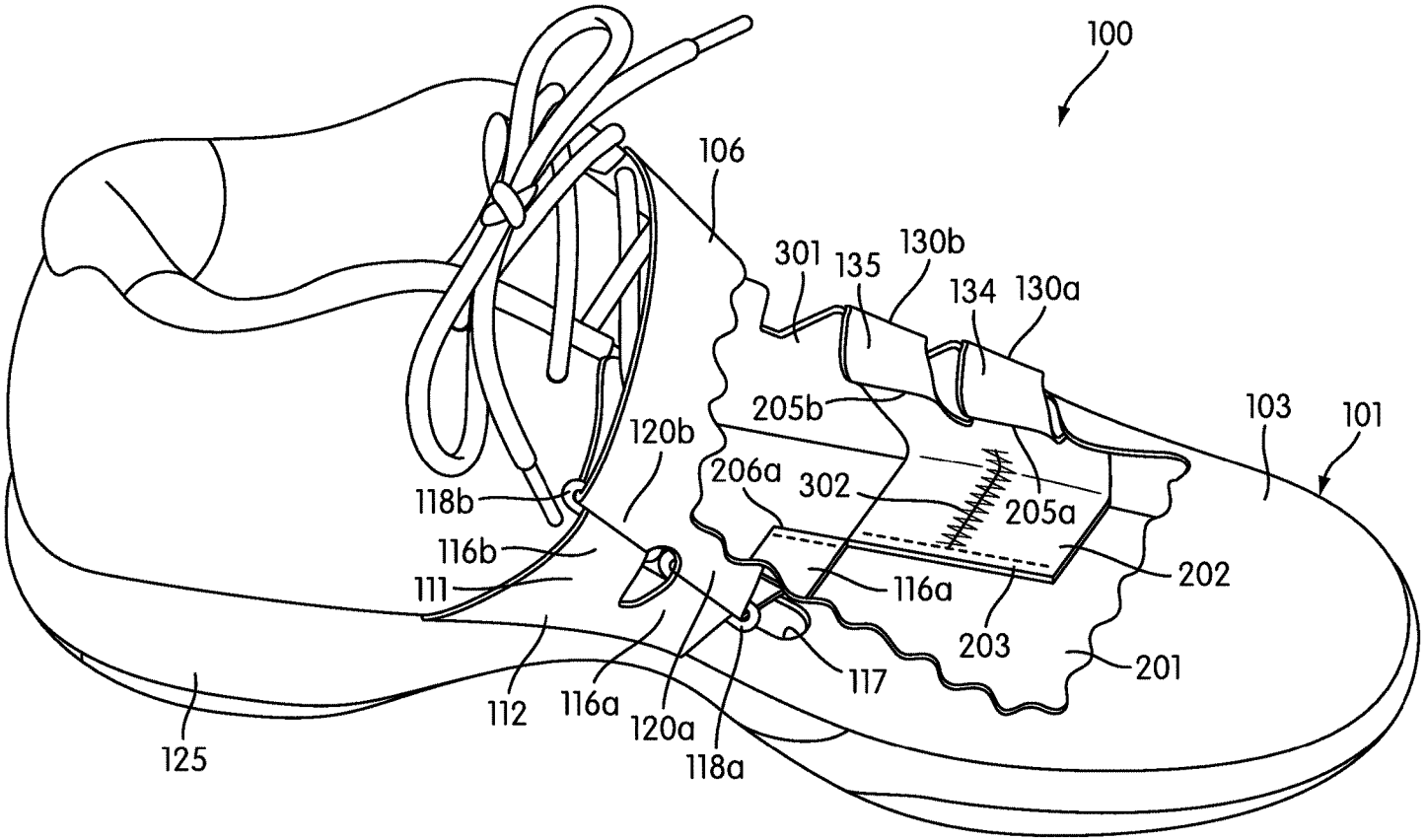
FIG. 3 is a medial perspective view of the article of footwear of FIG. 1A, and with portions of the article removed to show certain internal details.

FIG. 3 is a medial perspective view of shoe 100 similar to FIG. 1A, but in which portions of shell 103 have been removed to reveal forefoot harness 131. Portions of tongue 104, lace 105, liner 141 and the upper 101 insole in the vicinity of forefoot harness 131 have also been removed. Outer faces of main strap 202 and of substraps 205*a* and 205*b* contact an inside lateral surface 301 of shell 103, but are free to move relative to surface 301. Similarly, portions of main strap 202 extending outward across lasting sock 201 from end 203 are unattached to lasting sock 201 and can move relative to lasting sock 201.

In some embodiments, main strap 202 is formed by removing a small center portion and attaching the resulting edges with stitching 302. In this fashion, main strap 202 can be given a slightly concave shape to accommodate a protrusion of the wearer foot corresponding to the fifth metatarsal-phalangeal joint. In at least some other embodiments, main strap 202 can be replaced with separate straps so as to provide increased articulation. For example, substraps 205*a* and 205*b* could remain independent of one another and each have an end that is fixed to lasting sock 201 in a manner similar to ends 206*a* and 206*b* of midfoot harness 110 substraps 116*a* and 116*b*.

Figure 4:
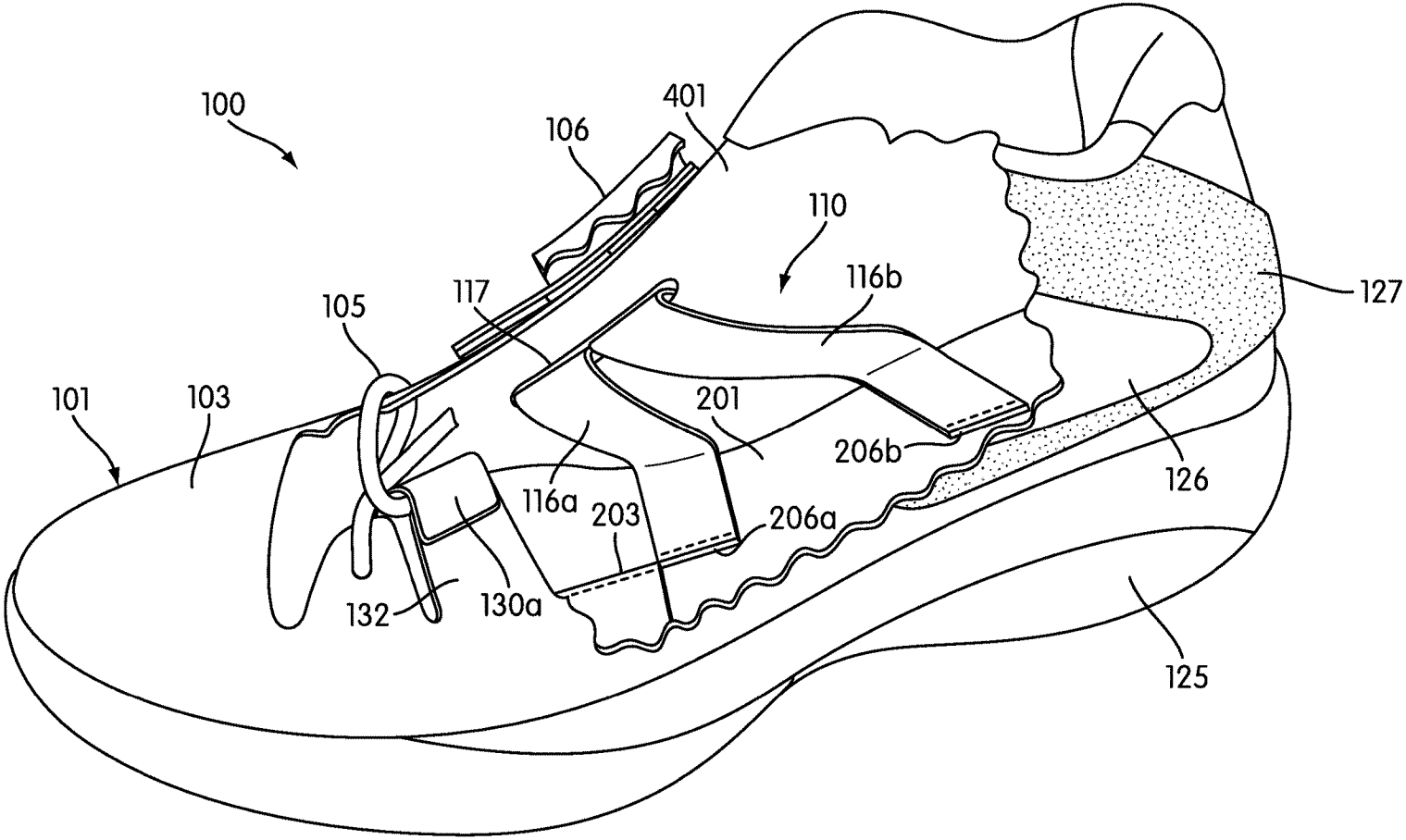
FIG. 4 is a lateral perspective view of the article of footwear of FIG. 1A, and with portions of the article removed to show certain internal details.

FIG. 4 is a lateral perspective view of shoe 100 similar to FIG. 1C, but in which other portions of shell 103 have been removed to reveal midfoot harness 110. Portions of tongue 104, lace 105, external strap 106, liner 141 and the upper 101 insole have also been removed. Forward substrap 116*a* extends through opening 117 in shell 103. Substrap 116*a* follows the medial inside surface 401 of shell 103 and extends across the surface of lasting sock 201 to end 206*a*. Rear substrap 116*b* similarly extends through opening 117, follows along inside surface 401 of shell 103, and extends across the surface of lasting sock 201 to end 206*b*. As indicated above, ends 206*a* and 206*b* are attached to lasting sock 201. Other portions of substraps 116*a* and 116*b* are unattached to lasting sock 201 or to surface 401, however, and can thus move relative to lasting sock 201 and surface 401.

In some embodiments, and as seen in FIG. 4, portions of substraps 116*a* and 116*b* near the interior side of opening 117 are slightly wider than other portions of substraps 116*a* and 116*b* that are closer to lasting sock 201. In particular, substraps 116*a* and 116*b* may in some embodiments taper slightly toward ends 206*a* and 206*b*. In other embodiments not shown in FIG. 4, substraps 116*a* and 116*b* may be replaced (in whole or in part) with a single strap. For example, a main strap of a midfoot harness could extend as a single piece through a single ring that replaces rings 118*a* and 118*b*, with that main strap then having an end secured to lasting sock 201 along the centerline of shoe 100. That main strap could widen inside upper 101 and have a forward edge that lies approximately where the forward edge of substrap 116*a* lies in FIG. 4, a rear edge that lies approximately where the rear edge of substrap 116*b* lies in FIG. 4, and an end edge that lies approximately along the shoe 101 centerline. As another example, a main strap of a midfoot harness could split into substraps similar to 116*a* and 116*b*, but those substraps could be rejoined into a single element after passing through opening 117. That single element could similarly have a forward edge that lies approximately where the forward edge of substrap 116*a* lies in FIG. 4, a rear edge that lies approximately where the rear edge of substrap 116*b* lies in FIG. 4, and an end edge that lies approximately along the shoe 101 centerline.

Figure 5:
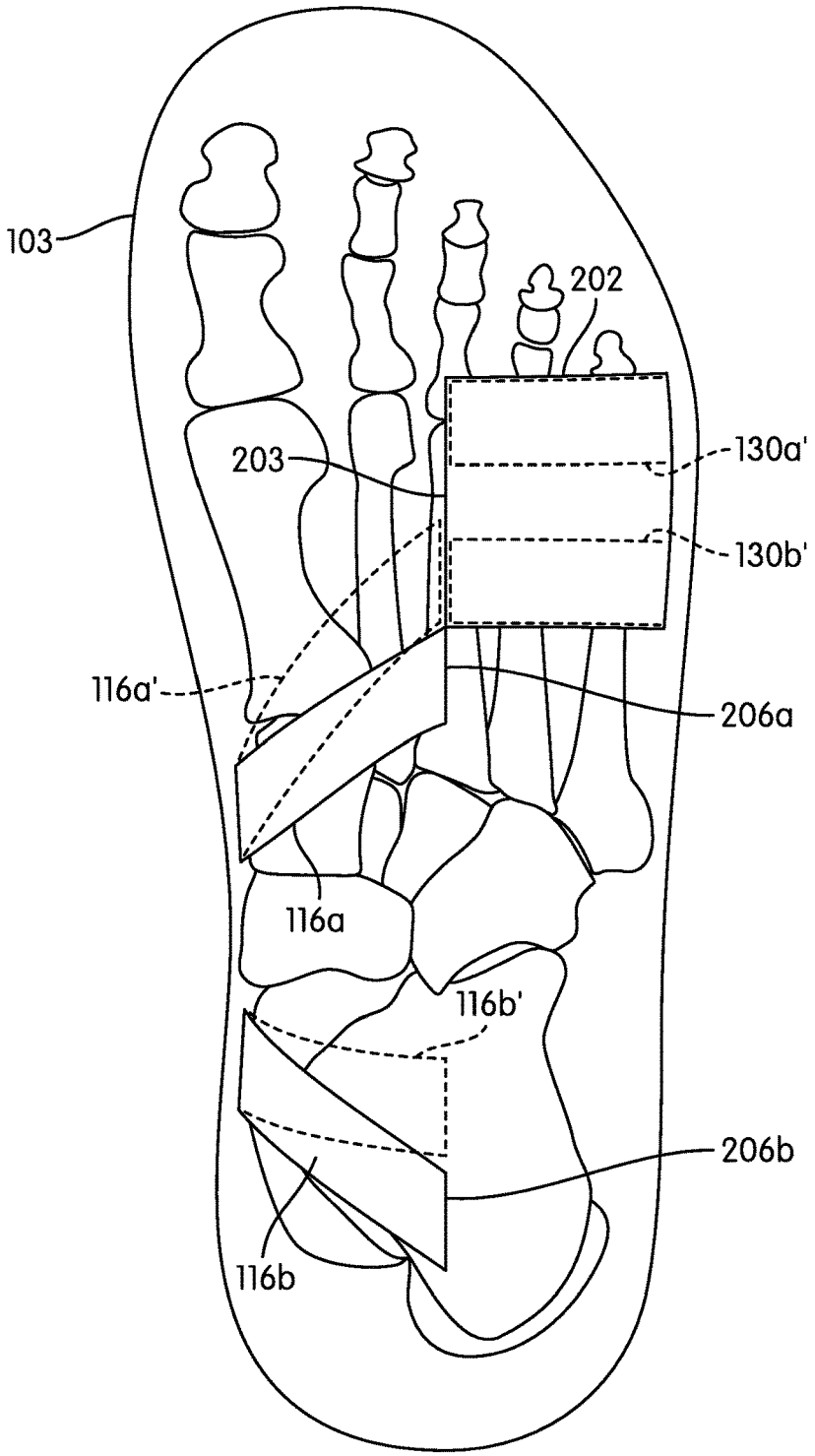
FIG. 5 is a partially schematic cross-sectional view taken from the location indicated in FIG. 1B.

FIG. 5 is a partially schematic cross-sectional view approximately taken from the location indicated in FIG. 1B. FIG. 5 shows a plantar view of the bones in the foot of a shoe 100 wearer, but only shows certain portions of shoe 100. Specifically, FIG. 5 only shows an approximate outline of shell 103 and portions of main strap 202, substrap 116*a* and substrap 116*b* lying under the wearer foot. Other components of shoe 100 have been omitted because the primary purpose of FIG. 5 is to show approximate locations of harness elements, in some embodiments, relative to certain bones of a wearer foot. Main strap 202 of forefoot harness 131 extends outward from end 203 and may lie under the distal ends of the third, fourth and fifth metatarsals, under substantially all of the fourth and/or fifth proximal phalanges, and under a portion of the third proximal phalanx.

In other embodiments, end 203 may be located to the medial or lateral side of the shoe centerline so as to lie under more or less of the bones in the center portion of the wearer foot. Similarly, main strap 202 could be wider so as to extend further toward the rear of the wearer foot. As indicated in connection with FIG. 3, harness 131 could also be implemented so as to have two substraps extending under the foot. For example, and instead of being joined to form main strap 202, substraps 130*a* and 130*b* could be extend under the wearer foot in approximately the locations indicated with broken lines 130*a*' and 130*b*'.

As also shown in FIG. 5, end 206*a* of midfoot harness 110 forward substrap 116*a* can be located under the proximate end of the third metatarsal and extend rearward and outward so as to lie under the proximal end of the first metatarsal and/or under the medial cuneiform. In other embodiments, the location of end 206*a* may be placed further forward or rearward, and/or may be located to the medial or lateral side of the shoe centerline, and/or the angle of substrap 116*a* across the footbed could be varied. For example, and as indicated with a broken line, a substrap 116*a*' could have an end placed further forward.

FIG. 5 further shows end 206*b* of midfoot harness 110 rear substrap 116*b* located under the wearer calcaneus. Substrap 116*b* extends outward and forward under the wearer foot. As with forward substrap 116*a*, the location of rear substrap 116*b* can be varied in other embodiments. The location of end 206*b* may be placed further forward or rearward, and/or may be located to the medial or lateral side of the shoe centerline, and/or the angle of substrap 116*b* could be varied. One example of an alternate location is shown in FIG. 5 with a broken line indicating substrap 116*b*'. The positions of substraps similar to substraps 116*a* and/or 116*b* could also be varied by moving a main strap similar to main strap 111 and/or an opening similar to opening 117 forward or rearward from the locations for main strap 111 and opening 117 shown in other drawing figures.

Figure 6:
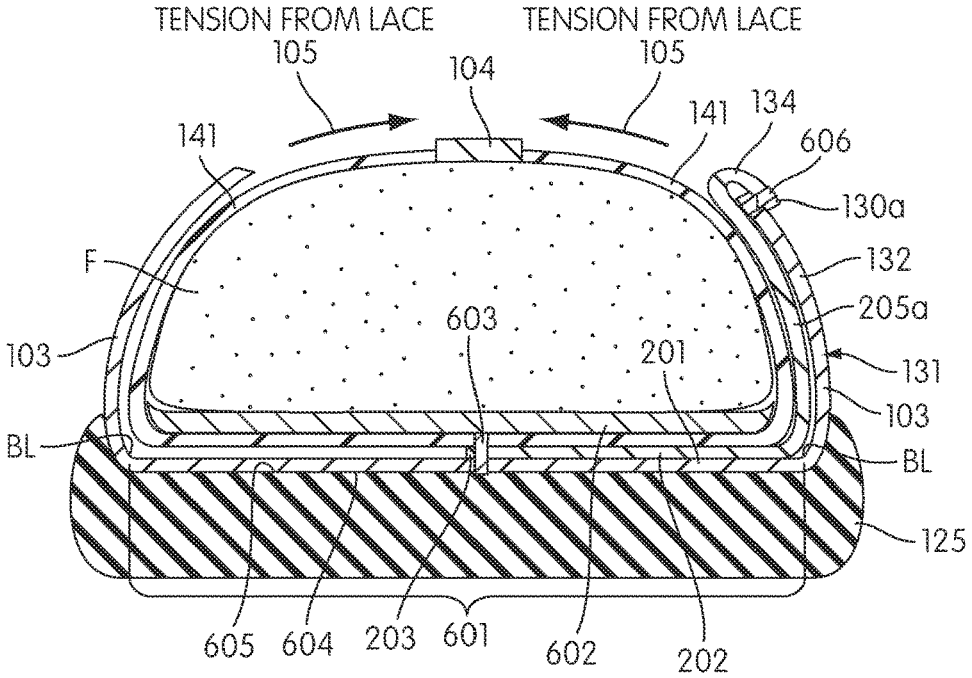
FIG. 6 is a partially schematic area cross-sectional view taken from the location indicated in FIG. 1D.

FIG. 6 is a partially schematic area cross-sectional view, taken from the location indicated in FIG. 1D, showing spatial relationships of interior components within a selected forefoot region of upper 101. For convenience, a simple irregularly-shaped area F roughly represents the outer boundary of a socked wearer foot in the cross-sectional plane of FIG. 6. Spacing between certain components in FIG. 6 has also been exaggerated for purposes of conveniently representing individual elements. Lace 105 has been omitted from FIG. 6. Tension on the sides of tongue opening 128 resulting from tightening of lace 105 is shown generally with arrows. Although edges of liner 141 meet edges of tongue 104 in the location of FIG. 6, tongue 104 may be wider in other embodiments. In such embodiments, sides of the tongue extending outward toward the lateral and medial sides (further to the left and right in a view similar to FIG. 6) could be positioned under the liner.

A portion of sole structure 125 provides an underfoot platform 601 for the foot of the shoe 101 wearer. Locations where an upper is bonded or otherwise joined to the peripheral edges of an underfoot platform are often referred to as a "bite line." Points of the shoe 100 bite line lying in the cross-sectional plane of FIG. 6 are indicated with a "BL." If shoe 100 perfectly fit the wearer foot, the bite line would closely conform to the perimeter of the wearer foot. In such a case, there would be no significant gap between the wearer foot and the bite line at the sides of shoe 100, and the upper might provide adequate transverse containment of the foot during rapid sideways maneuvers.

Unfortunately, the fit of a shoe on a given individual may sometimes be less than optimal. As a commercial practicality, shoes may be manufactured in a limited number of standardized sizes. Each size is often designed to accommodate feet within a certain target range of possible lengths and widths. This may be true even when a particular type of shoe is available in both wide and narrow sizes (e.g., size 9 regular, size 9 narrow, size 9 wide). For any given size of shoe, there may be persons having feet that are in the narrower part the target width range. Some persons may even have one foot that is slightly narrower than the other, thereby making it very difficult to find a pair of shoes that optimally fit both feet.

For persons having feet (or a foot) in the narrow portion of the target width range for a particular shoe size, any excess space between the sides of a wearer foot and the bite line may not be noticeable during casual walking or when running in a straight line. However, that excess space may become noticeable when the wearer performs a rapid sideways maneuver. During such a maneuver, the wearer foot may push to the side with increased force. As a result, and unless additional restraint is provided, the foot may slide across the underfoot platform until the foot is pushed firmly against the side of the upper. For example, a person wearing a shoe and cutting to the right may push against the lateral side of his left shoe with his left forefoot. If there is excess space between the lateral side of the left forefoot and the lateral edge of the left shoe underfoot platform, the foot may move excessively within the shoe.

In the example of FIG. 6, a wearer of shoe 100 has a foot with a width in the region of the FIG. 6 that is less than optimal. For example, the wearer's foot may be in the narrower part of the target width range for the size of shoe 100. Thus, the wearer's foot is slightly less wide than a maximum foot width that shoe 100 is designed to accommodate in the region of FIG. 6. Accordingly, there is a small amount of excess space between the sides of the wearer foot and the edges of the underfoot platform in the region of FIG. 6. However, forefoot harness 131 can be tightened so as to prevent excess movement of the wearer foot within this excess space.

As seen shown in FIG. 6, the wearer foot rests on an insole (or sock liner) 602. Insole 602 may be formed from foam and/or may be shaped to comfortably conform to the underside of a wearer foot. Insole 602 is contained within liner 141. Liner 141 may be formed from, e.g., a mesh material. The top edges of liner 141 are bonded to the sides of tongue 104. Although not shown in FIG. 6, liner 141 may be attached to shell 103 in selected locations near the edges of tongue opening 128.

For convenience, FIG. 6 shows insole 602 and edges of liner 141 being slightly narrower than the width of platform 601 at the location of FIG. 6. In some embodiments, insole 602 may be sized so that its edges (less the thickness of liner 141) are approximately located at the bite line BL. The edges of insole 602 may then be pulled upward and conform to a wearer's foot in response to the action of harnesses 131 and 110 as described herein.

As further seen in FIG. 6, end 203 of forefoot harness 131 main strap 202 is secured to lasting sock 201 and liner 141 with stitching 603. Because the underside 604 of lasting sock 201 is bonded to the top 605 of sole structure 125, end 203 is effectively fixed relative to sole structure 125. Substrap 205*a* extends from main strap 202 to anchor portion 130*a*, with anchor portion 130*a* attached to tab 132 with stitching 606. As seen in FIGS. 2 and 3, substrap 205*b*, also extends from main strap 202. Although not visible in FIG. 6, anchor portion 130*b* of substrap 205*b* is attached to tab 133 with stitching in a manner similar to that shown in FIG. 6.

Forefoot harness 131 is not attached to lasting sock 201 or liner 141 602 at any location other than stitching 603. Similarly, harness 131 is not attached to shell 103 at any location other than stitching 606 and the stitching that joins anchor portion 130*b* to tab 133. The portions of harness 131 between these stitching locations wrap around the bottom and lateral side of the wearer forefoot, but can otherwise move relative to lasting sock 201, liner 141 and shell 103. When tension is applied to lace 105, the tension is transferred to these movable wrapping portions of harness 131 by pulling on loops 134 and 135 (see FIG. 1C). Harness 131 thereby forms a restraint, within the interior of upper 101, that limits movement of the wearer forefoot toward the lateral side during a rapid sideways maneuver. Because harness 131 is not attached at the bite line BL, the ability to restrain the wearer foot is not limited by the width of the footbed.

Figure 7:
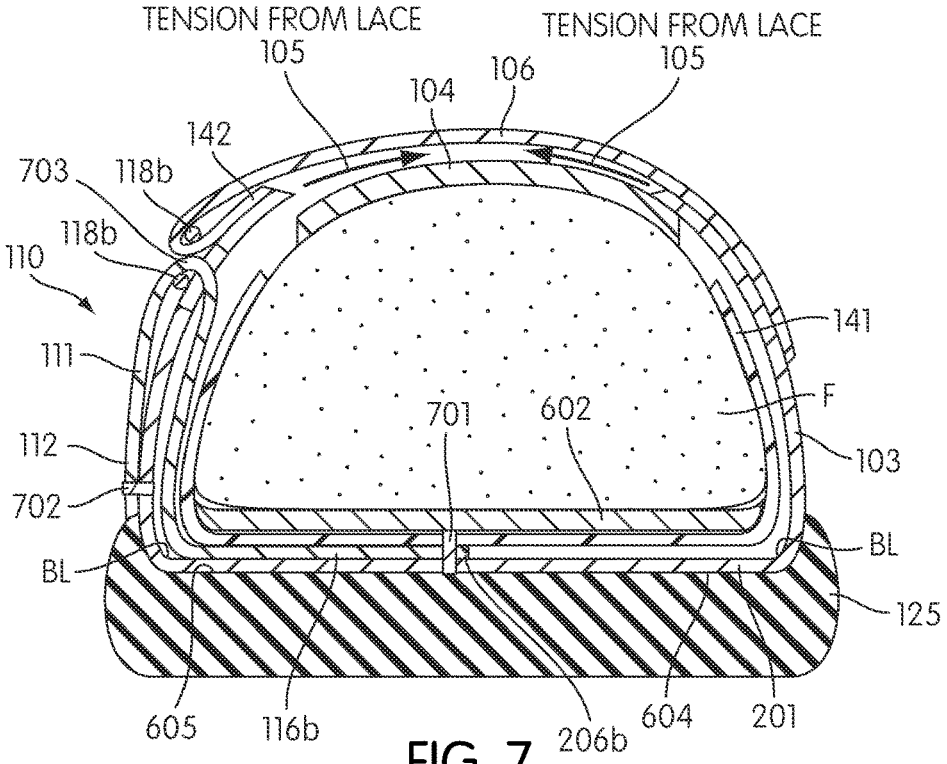
FIG. 7 is a partially schematic area cross-sectional view taken from the location indicated in FIG. 1B.

FIG. 7 is a partially schematic area cross-sectional view, taken from the location indicated in FIG. 1B, showing spatial relationships of interior components within selected mid- and hindfoot regions of upper 101. As in FIG. 6, a simple irregularly-shaped area F roughly represents the outer boundary of a socked wearer foot in the region of FIG. 7. Spacing between certain components in FIG. 7 has also been exaggerated for purposes of conveniently showing distinct elements, and lace 105 has been omitted.

The wearer of shoe 100 has a foot width in the region of FIG. 7 that is slightly less than a maximum width that shoe 100 is designed to accommodate in the same region. As a result, and similar to the forefoot region described in connection with FIG. 6, there is a small amount of excess space between the sides of the wearer foot and the edges of the underfoot platform in the region of FIG. 7. However, midfoot harness 110 can be tightened so as to prevent excess movement of the wearer foot within this excess space.

Stitching 701 secures end 206*b* of midfoot harness 110 rear substrap 116*b* to lasting sock 201 and liner 141. Although not shown in FIG. 7, end 206*a* of forward substrap 116*a* is attached to lasting sock 201 and liner 141 with stitching in a manner similar to that shown in FIG. 7. The location of the end 206*a* attachment can be seen in FIGS. 2, 4 and 5. As previously shown in connection with FIGS. 1A and 1B, rear substrap 116*b* and forward substrap 116*a* (not shown in FIG. 7) are extensions of (and thus connected to) main strap 111. Main strap 111 is attached to shell 103 with stitching 702 at anchor portion 112. Rear substrap 116*b* is not attached to lasting sock 201 or liner 141 at any location other than stitching 701. Similarly, forward substrap 116*a* is not attached to lasting sock 201 or liner 141 at any location other than stitching located at end 206*a* (see FIGS. 2 and 4). Main strap 111 is not attached to shell 103 at any location other than stitching at anchor portion 112. As a result, portions of harness 110 between these stitching locations wrap around the bottom and medial side of the wearer mid- and hindfoot, and these same portions can move relative to lasting sock 201, liner 141 and shell 103.

As indicated above, end 142 of external strap 106 is secured to shell 103 when lace 105 is routed through the aligned holes of end 142 and shell 103, and when lace 105 is then tied. When tension is then applied to strap 106 by pulling strap 106 across shoe 100, that tension is transferred to harness 110 by rings 118*a* and 118*b*. This transferred tension results in upward pulling on the loops formed by the folded over portions of substraps 116*a* and 116*b*. One such loop 703 is shown is noted in FIG. 7. A similar loop is formed by substrap 116*a* in the region of ring 118*a*. Upward pulling causes substraps 116*a* and 116*b* to wrap around the bottom and medial sides of the wearer mid- and hindfoot. In this manner, harness 110 forms a restraint and limits movement of the wearer foot to the medial side during cutting maneuvers.

Returning to FIG. 1E, in at least some embodiments a lacing angle between the midpoint of lace loops 134 and 135 and eye 143*a* is approximately 75 degrees relative to the longitudinal axis of shoe 100 (i.e., approximately 15 degrees relative to a transverse axis that is perpendicular to the longitudinal axis). In this manner, lace 105 can roughly align with the force exerted on shoe 100 during many sideways maneuvers.

Figure 8:
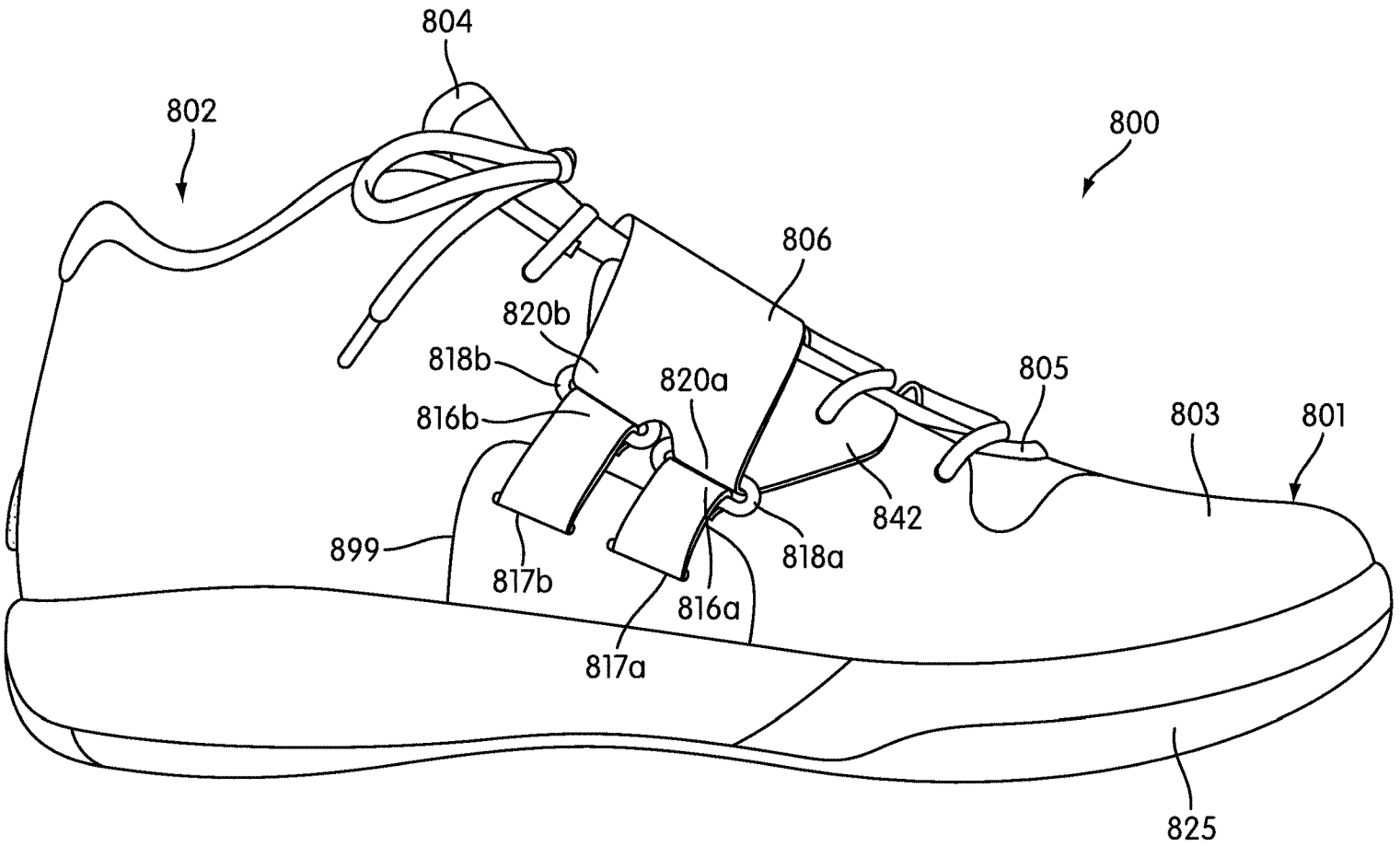
FIG. 8 is a medial side view of an article of footwear according to additional embodiments.

FIG. 8 is a medial side view of a shoe 800 according to certain additional embodiments. Except as described below, shoe 800 is generally similar to shoe 100 described above. Upper 801, ankle opening 802, shell 803, tongue 804, lace 805, external strap 806, rings 818*a* and 818*b*, substraps 820*a* and 820*b*, sole structure 825 and end 842 are similar to upper 101, ankle opening 102, shell 103, tongue 104, lace 105, external strap 106, rings 118*a* and 118*b*, substraps 120*a* and 120*b*, sole structure 125 and end 142, respectively, of shoe 100. Unlike shoe 100, however, a midfoot harness lacks a main strap that splits into substraps. Instead, the midfoot harness of shoe 800 includes a first independent strap 816*a* and a second independent strap 816*b*. Strap 816*a* has a pulling portion that is attached to ring 818*a*, with ring 818*a* also containing substrap 820*a*. Strap 816*a* extends into the interior of upper 801 through opening 817*a* and includes a portion within that interior that is similar to the portion of substrap 116*a* shown in FIG. 4. An end of strap 816*a* is attached to the shoe 800 lasting sock in a location similar to that shown for end 206*a* in FIG. 4, but strap 816*a* is not otherwise attached to shell 803 or to the shoe 800 lasting sock. Strap 816*b* has a pulling portion that is attached to ring 818*b*, with ring 818*b* also containing substrap 820*b*. Strap 816*b* extends into the interior of upper 801 through opening 817*b* and includes a portion within that interior that is similar to the portion of substrap 116*b* shown in FIG. 4. An end of strap 816*b* is attached to the shoe 800 lasting sock in a location similar to that shown for end 206*b* in FIG. 4, but strap 816*b* is not otherwise attached to shell 803 or to the shoe 800 lasting sock. A panel 899 reinforces the region of shell 803 around openings 817*a* and 817*b*.

Figure 9:
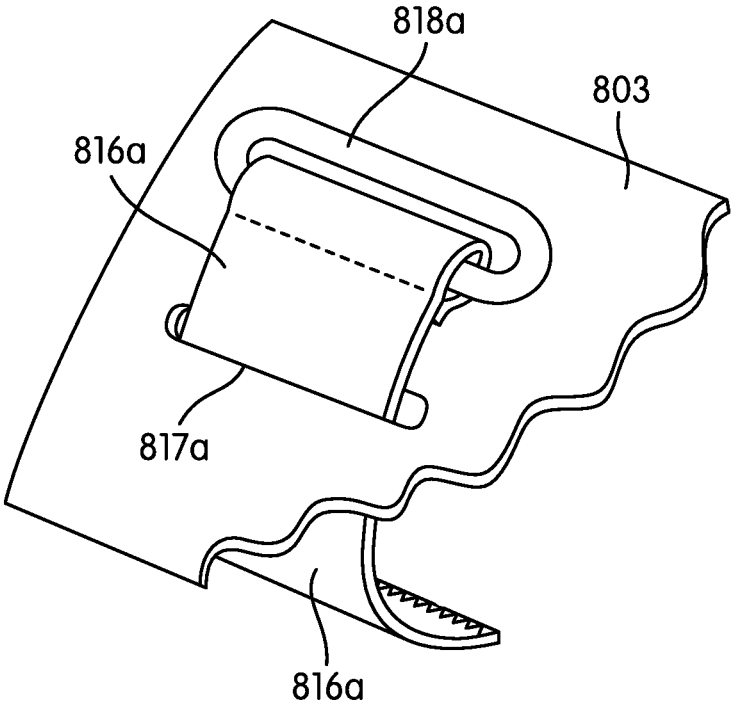
FIG. 9 is a partially schematic perspective view showing portions of components from the article of footwear from FIG. 8.

FIG. 9 is a partially schematic perspective view showing portions of components from shoe 800 of FIG. 8. Panel 899 is omitted from FIG. 9 for convenience. The midfoot harness of shoe 800 operates in a manner similar to that of midfoot harness 110 of shoe 100. Specifically, tension on external strap 806 is transferred, via substraps 820*a* and 820*b*, to rings 818*a* and 818*b*. That tension pulls upward on straps 816*a* and 816*b* and causes those straps to conform to medial mid- and hindfoot regions of a wearer's foot.

Shoes having one or more harness configurations such as are described above can offer several advantages, particularly in the case of a wearer with a foot that might be slightly narrow for a particular size of such a shoe. A network of straps is located within the upper. Those straps are coupled to the shoe at locations that permit the straps to conform to the wearer foot when the straps are tightened. Moreover, the conforming fit of the straps is not restricted by an attachment at the bite line. The interconnection of the strap network with shoe lacing system permits simultaneous (and complimentary) tightening of both the upper and the strap network.

Additional embodiments include numerous additional variations on one or more of the elements described thus far. In some embodiments, for example, only a lateral forefoot harness is included. In other embodiments only a medial midfoot harness is included. The widths and locations of harness straps can be varied, as can be the location at which a harness is anchored and/or fixed. As but one example, anchor portion 112 of midfoot harness 110 could also (or alternatively) be attached to sole structure 125 near an interface between shell 103 and sole structure 125. Attachment mechanisms other than stitching can be utilized.

The elements used to tighten a harness and/or to couple a harness to a tightening component (e.g., laces, an external strap) can be varied. In some embodiments, for example, rings 118*a* and 118*b* can be a single ring, which single ring may or may not include a center divider to maintain separation between substraps. In some embodiments, the harness(es) may be tightened independently of the lacing used to secure and tighten the upper.

As previously indicated, embodiments include shoes in which an upper may have mesh panels or openings to expose interior components. In some additional embodiments, an upper may simply be a network of outer straps connected a tooling edge of a sole structure. One or more harnesses can then provide an internal strap network that operates as described above.

In some embodiments, substraps of a forefoot harness may be joined in regions near lace loops. For example, a reinforcing panel of material could be attached so as to span regions similar to anchor portions 130*a* and 130*b* of strap 131 and to span corresponding portions of the sides of associated lace loops (similar to loops 134 and 135) facing the tongue. That reinforcing panel could extend forward so as to include a lacing eye located further forward (e.g., a lacing eye similar to the lateral side lacing eye forward of loop 134 in FIG. 1C) and/or extend rearward so as to include a lacing eye located further rearward (e.g., a lacing eye similar to the lateral side lacing eye immediately to the rear of loop 135). In yet other embodiments, a forefoot harness includes a main strap that does not divide into substraps and that remains a single piece having a width similar to that of harness 131. A mesh panel could be located in an upper shell over the forefoot harness so as to expose elements of that harness located within the upper interior.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in a claim to characteristics of a physical element relative to a wearer of claimed article, or relative to an activity performable while the claimed article is worn, do not require actual wearing of the article or performance of the referenced activity in order to be within the scope of the claim.

The invention claimed is:

1. An article of footwear comprising:

a sole structure;

an upper attached to the sole structure and defining an interior above the sole structure, the interior including a footbed;

a first strap located in the interior and having a first fixed portion, a first pulling portion and a first wrapping portion extending between the first fixed and pulling portions, wherein the first fixed portion is attached to the sole structure in a midfoot region of the footbed at a bottom of the interior such that an end of the first fixed portion is positioned at a longitudinal centerline of the sole structure, the longitudinal centerline being positioned centrally between lateral and medial sides of the sole structure, and is substantially immovable relative to the sole structure, wherein the first wrapping portion is unattached to the upper or sole structure, wherein the first strap is positioned entirely above a bottom of the interior of the upper, and wherein the first strap extends from the first fixed portion, across the footbed along the bottom of the interior toward a medial interior side of the footbed, and upward along the medial interior side of the upper;

a second strap located in the interior and having a second fixed portion, a second pulling portion and a second wrapping portion extending between the second fixed and pulling portions, wherein the second fixed portion is attached to the sole structure in a hindfoot region of the footbed at a bottom of the interior such that an end of the second fixed portion is positioned at the longitudinal centerline of the sole structure, and is substantially immovable relative to the sole structure, wherein the second wrapping portion is unattached to the upper or sole structure, wherein the second strap is positioned entirely above a bottom of the interior of the upper, and wherein the second strap extends from the second fixed portion, across the footbed along the bottom of the interior toward the medial interior side of the footbed, and upward along the medial interior side of the upper; and a tensioning element coupled to the first and second pulling portions;

wherein the end of the first fixed portion positioned along the longitudinal centerline of the sole structure is spaced from the end of the second fixed portion positioned along the longitudinal centerline of the sole structure.

2. The article of footwear of claim 1, wherein a separation between the first and second straps decreases in a medial transverse direction from the first and second fixed portions.

3. The article of footwear of claim 1, wherein the tensioning element comprises a strap end though which a lace passes.

4. The article of footwear of claim 1, wherein the tensioning element comprises an exterior strap.

5. The article of footwear of claim 1, wherein the first and second straps are connected to a main strap, and wherein the main strap includes an anchor portion fixed to at least one of the upper and the sole structure.

6. The article of footwear of claim 5, wherein the tensioning element comprises an external strap having a first portion coupled to the first and second pulling portions and a second portion configured for releasable attachment to an outer surface of the upper located on a lateral side of the upper.

7. The article of footwear of claim 6, further comprising at least one ring coupling the first portion to the first and second pulling portions, wherein the external strap includes a third portion having lace eyes, and wherein the first portion is between the second and third portions.

8. The article of footwear of claim 6, wherein the external strap includes a third portion having at least one lace eye, and wherein the first portion is between the second and third portions.

9. The article of footwear of claim 1, wherein the first and second pulling portions are coupled to a midfoot harness anchor portion located on an exterior of the article and attached to at least one of the upper and the sole structure.

10. The article of footwear of claim 1, wherein the first and second pulling portions are located above a bite line of the article when the article is worn by a wearer.

11. An article of footwear comprising:

a sole structure;

an upper attached to the sole structure and defining an interior above the sole structure, the interior including a footbed;

a forward strap having a fixed portion and extending across the footbed from the fixed portion, along a bottom of the interior toward an interior medial side of the upper, and upward along the interior medial side of the upper, through a medial side opening of the upper, and to an exterior of the article, wherein the fixed portion of the forward strap is laterally displaced inwardly along the bottom of the interior from a medial edge of the footbed such that an end of the fixed portion of the forward strap is positioned at a longitudinal centerline of the footbed, the longitudinal centerline being positioned centrally between lateral and medial sides of the footbed, and is immovable relative to the sole structure in a midfoot region, wherein the forward strap is positioned entirely above the bottom of the interior, and wherein a portion of the forward strap between the fixed portion and the medial side opening is unattached to the upper or sole structure; and a rear strap having a fixed portion and extending across the footbed from the fixed portion, along a bottom of the interior toward the interior medial side of the upper, and upward along the interior medial side of the upper, through the medial side opening of the upper, and to the exterior of the article, wherein the fixed portion of the rear strap is laterally displaced inwardly along the bottom of the interior from the medial edge of the footbed such that an end of the fixed portion of the rear strap is positioned at the longitudinal centerline of the footbed and is immovable relative to the sole structure in a hindfoot region, wherein the forward strap is positioned entirely above the bottom of the interior, and wherein a portion of the rear strap between the fixed portion and the medial side opening is unattached to the upper or sole structure;

wherein the end of the forward strap fixed portion positioned at the longitudinal centerline of the footbed is spaced from the end of the rear strap fixed portion positioned at the longitudinal centerline of the footbed.

12. The article of footwear of claim 11, wherein a location of the medial side opening along the length of the article is between a location of forward strap fixed portion and a location of the rear strap fixed portion.

13. The article of footwear of claim 11, wherein a separation between the forward and rear straps decreases in a medial transverse direction from the forward strap fixed portion and the rear strap fixed portion.

14. The article of footwear of claim 11, wherein the forward strap fixed portion and the rear strap fixed portion pass under an insole.

15. The article of footwear of claim 11, further comprising an external strap having a first portion coupled to the forward and rear straps and a second portion configured for releasable attachment to a lateral side outer surface of the upper.

16. The article of footwear of claim 15, further comprising at least one ring coupling the first portion to the forward and rear straps, wherein the external strap includes a third portion having lace eyes, and wherein the first portion is between the second and third portions.

17. The article of footwear of claim 15, wherein the external strap includes a third portion having at least one lace eye, and wherein the first portion is between the second and third portions.

* * * * *